US008696084B2

(12) United States Patent
Nakamaki

(10) Patent No.: US 8,696,084 B2
(45) **Date of Patent: *Apr. 15, 2014**

(54) METHOD OF CONTROLLING PRINTING IN A PRINTER, AND A PRINTER

(71) Applicant: Seiko Epson Corporation, Tokyo (JP)

(72) Inventor: Motohiro Nakamaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/785,473

(22) Filed: Mar. 5, 2013

(65) Prior Publication Data

US 2013/0235109 A1 Sep. 12, 2013

Related U.S. Application Data

(63) Continuation of application No. 12/534,454, filed on Aug. 3, 2009, now Pat. No. 8,414,099.

(30) Foreign Application Priority Data

Aug. 1, 2008 (JP) ..... 2008-199361

(51) Int. Cl.
*B41J 29/38* (2006.01)

(52) U.S. Cl.
USPC ..... 347/16

(58) Field of Classification Search
CPC ..... B41J 11/0025; B41J 13/0009
USPC ..... 347/16, 37, 101, 104; 358/1.13, 1.15
See application file for complete search history.

(56) References Cited

U.S. PATENT DOCUMENTS

| | | | | |
|---|---|---|---|---|
| 6,594,028 | B1 | 7/2003 | Hamamoto et al. | |
| 7,207,637 | B2 | 4/2007 | Huang | |
| 7,533,959 | B2 | 5/2009 | Ouchi et al. | |
| 8,414,099 | B2 * | 4/2013 | Nakamaki | 347/16 |
| 2006/0237901 | A1 | 10/2006 | Utsumi et al. | |
| 2010/0025450 | A1 | 2/2010 | Nakamaki | |

FOREIGN PATENT DOCUMENTS

| | | | |
|---|---|---|---|
| JP | 59093374 | A | 5/1984 |
| JP | 61020780 | A | 1/1986 |
| JP | 08221238 | A | 8/1996 |
| JP | 10016345 | A | 1/1998 |
| JP | 2004358672 | A | 12/2004 |
| JP | 2005088303 | A | 4/2005 |
| JP | 2006106485 | A | 4/2006 |

* cited by examiner

*Primary Examiner* — An Do
(74) *Attorney, Agent, or Firm* — Nutter McClennen & Fish LLP; John J. Penny, Jr.; Christina M. Sperry

(57) ABSTRACT

A printer enables setting roll paper in a center-referenced position based on received paper width information, and printing correctly to the printing area of the paper set to the centered position. When the paper width of the paper used for printing is not contained in the received data, the printer sets the paper width of the paper for printing to the maximum paper width. The distance L from the edge of the transportation path to the start printing position of the inkjet head is also set to L=Lm (where Lm is the size of the margin on the paper). When the paper width is contained in the received data, the position where the paper is set is the center reference, and the received paper width is set as the paper width of the paper used for printing.

9 Claims, 7 Drawing Sheets

| | |
|---|---|
| L | DISTANCE FROM EDGE OF TRANSPORTATION PATH TO START PRINTING POSITION |
| La | WIDTH OF THE TRANSPORTATION PATH (MAXIMUM PAPER WIDTH) |
| Lb | PAPER WIDTH OF THE PAPER USED FOR PRINTING |
| Lm | MARGIN FROM EDGE OF PAPER |

L DISTANCE FROM EDGE OF TRANSPORTATION PATH TO START PRINTING POSITION
La WIDTH OF THE TRANSPORTATION PATH (MAXIMUM PAPER WIDTH)
Lb PAPER WIDTH OF THE PAPER USED FOR PRINTING
Lm MARGIN FROM EDGE OF PAPER

METHOD OF CONTROLLING PRINTING IN A PRINTER, AND A PRINTER

This application claims priority under 35U.S.C. §120 to U.S. patent application Ser. No. 12/534,454, now U.S. Pat. No. 8,414,099, filed on Aug. 3, 2009 and claims priority under 35 U.S.C. §119 to Japanese Patent Application No. 2008-199361 filed on Aug. 1, 2008, the entire disclosures of which are expressly incorporated by reference herein.

BACKGROUND

1. Technical Field

The present invention relates to a printer that can print to paper of different widths, and to a control method for the printer.

2. Related Art

A reference position for loading the paper is commonly set in printers that print using a print head that is mounted on a carriage and travels widthwise to the paper. This reference position may be a left-edge reference (or right-edge reference, here and below) for positioning the left edge of the paper to the left side (or right side, here and below) of the paper transportation path, or it may be a center reference for positioning the paper in the center of the paper transportation path. When a left-edge reference is used and the left margin is constant, the start printing position of the print head is the home position of the print head (the left end of the range of print head movement) or a position at a constant distance from the left side of the paper transportation path. This configuration has the advantage of not needing to adjust the start printing position of the print head when the paper width changes, and enables printing to always start from the same position (start printing position).

If a center reference is used, however, the start printing position of the print head must be adjusted when the paper width changes even if the margin at the left side of the printing area remains the same because the position where the print head starts printing shifts widthwise to the paper. Therefore, in order to print accurately within the printing area of the paper, information such as the paper width or the positions of both the left and right edges of the paper are required in addition to the size of the left margin at the left side of the printing area.

In the case of a printer in which roll paper is loaded for printing, however, the balance will shift if a heavy roll of paper is set to the left or right side of the roll paper compartment. Setting the roll paper in the center of the roll paper compartment has the advantage of facilitating loading the roll paper and improved operational stability during printing. More particularly, because setting the roll paper in the center of the roll paper compartment affords more space and avoids the sides of the roll paper compartment where it can be difficult to reach by hand, the ease of loading the paper is improved. Paper transportation stability is also improved because the paper is not set to an unbalanced position on the left or right side. When the roll paper is loaded in the center of the roll paper compartment, the paper pulled off the roll is also positioned to the center reference of the transportation path. This makes adjusting the start printing position according to the width of the paper necessary as described above, and requires information about the paper width or the positions of the left and right edges of the paper.

Japanese Unexamined Patent Appl. Pub. JP-A-H10-16345 teaches a printer that detects the left and right edges of the paper and adjusts the start printing position of the print head. The printer taught in JP-A-H10-16345 detects the left edge and right edge of the paper by a paper sensor mounted on the carriage. If the position of the detected left edge is at the reference position, this printer prints without adjusting the start printing position, but if the position of the left edge is not at the reference position, the start printing position of the print head is adjusted for printing according to the position of the detected left edge. The start printing position of the print head can thus be automatically adjusted.

A problem with the method of detecting the paper edge each time by a paper sensor as taught in JP-A-H10-16345, however, is that processing by the printer becomes time consuming.

One conceivable solution is for the host device to send such information as the paper width or the reference position of the paper used for printing to the printer, thereby enabling the printer to acquire the necessary information and adjust the start printing position of the print head without executing a detection operation using a paper sensor.

However, generating the paper width or reference position information on the host device side and sending this information to the printer for each print job increases the processing load on the host device side while also requiring processing time on the printer side. When the paper width does not change, or there is a left-edge reference or right-edge reference that remains a constant reference printing position, it is preferable for the host device to not need to generate and send this information to the printer and the printer to not need to receive and process the information.

SUMMARY

At least one embodiment of the present invention is directed to solving the foregoing problem.

More particularly, a printer and a printer control method according to at least one embodiment of the present invention can differentiate a left-edge reference (or right-edge reference) and center reference based on whether or not paper width information is received from the host device, can accelerate operation by eliminating redundant detection operations, communication, and processing, and can print accurately to the printing area of the paper whether a left, right, or center reference is used.

A printer and printer control method according to another aspect of the invention can also prevent printing to a position outside the paper by adjusting the printing area.

A printing control method according to at least one embodiment of the present invention is a printing control method for a printer that is connectable to a host device, conveys paper through a transportation path, and prints while moving a print head mounted on a carriage, the printing control method having a step of determining that the paper is set to a position referenced to the center of the transportation path in the paper width direction when paper width information is received from the host device.

Preferably, the printing control method determines that the paper is set to a position referenced to an edge of the transportation path in the paper width direction when paper width information is not received from the host device.

Further preferably, when the paper width information is received, the received paper width is set as the paper width of the paper used for printing, and when the paper width information is not received, a stored paper width value is used as the paper width of the paper used for printing.

Adjustment based on the paper width is necessary only when the paper is center referenced. It is therefore sufficient to send the paper width information from the host device connected to the printer only in this situation, and the printer can know that the paper is in the centered position when this paper width information is received. Furthermore, when the paper width information is not sent, it can be determined that the paper width or the reference position of the paper has not changed, or that the printing reference position (the boundary between the margin and the printing area, or the start printing position) is a constant position referenced to an edge of the transportation path, such as a left-side reference or right-side reference position.

At least one embodiment of the invention can thus determine the width of the paper used for printing based on whether or not paper width information is received from the host device, can determine when the paper is positioned referenced to the center or an edge position relative to the determined paper width, and can set the start printing position accordingly.

When the paper is set centered to the paper loading unit or transportation path, the printer can determine that the paper is centered by simply receiving the paper width information, and printer processing is thus faster. When the paper is centered, loading the paper is easier and the stability of paper transportation can be improved. More specifically, because the paper can be loaded in the center, avoiding the edges of the paper loading unit that can be difficult to access by hand, the paper can be loaded more easily, the paper is not set off-center to the left or right side, and the stability of paper transportation can be improved. The printer can also print accurately to the printing area of paper loaded in the center.

Furthermore, processing is faster when the paper width changes, or the paper is set to the left or right side, because there is no need for the host device to generate and send information about the reference position of the paper to the printer.

When the paper width information is not received, at least one embodiment of the invention can also set the printing reference position so that the printing operation is executed from the left edge or right edge of the paper based on paper width information previously stored in memory and margin information. This aspect of the invention enables appropriately using an edge reference and a center reference as needed. Furthermore, because it is not necessary to send paper width information from the host device when printing referenced to a paper edge, the processing load of the printer is reduced and processing is faster.

The printing reference position may be the start printing position of the print head. Because the paper width of the paper used for printing and the reference position of the paper are determined according to the presence of paper width information from the host device with the foregoing method, the start printing position can be set if the size of the margin is previously stored in memory or is received from the host device. Furthermore, if the start printing position can be determined, it is possible to print to the correct position referenced to the start printing position.

In a printing control method for a printer according to another aspect of the invention, the maximum width of paper that can be set in the transportation path is pre-stored in memory. When printing commences without receiving the paper width information, the maximum paper width is set as the paper width of the paper used for printing, and the distance L from the edge of the transportation path to the start printing position is set to L=Lm where Lm is the size of the margin at the edge of the paper.

Further preferably, when printing after receiving the paper width information, the start printing position may be set so that the distance L from the edge of the transportation path to the start printing position is set to $L=\frac{1}{2}La-\frac{1}{2}Lb+Lm$ where La is the width of the transportation path, Lb is the paper width of the paper used for printing, and Lm is the printing margin of the paper. The width La of the transportation path is substantially equal to the maximum paper width.

Paper of the maximum paper width is located at the same position whether it is aligned to an edge or the center of the transportation path. Therefore, if printing is controlled referenced to an edge when the maximum paper width is used, the paper width information is not needed and the start printing position can be set to L=Lm. The start printing position can also be set to L=Lm if the center reference is used. On the other hand, if paper with a paper width less than the maximum paper width is set to the center position, the start printing position of the print head can be aligned with the edge of the printing area on the paper by setting the start printing position to $L=\frac{1}{2}La-\frac{1}{2}Lb+Lm$.

In a printing control method according to another aspect of the invention, when a position of the paper on the transportation path is detected after the paper width information is received from the host device, and the position of the paper determined based on the paper width information and the detected position of the paper do not match, a specific error state is entered or printing by the print head is executed only within the range of the detected paper position.

The process of this aspect of the invention automatically moves the position where the paper is set from the edge reference to the center reference when the paper width information is received. As a result, problems such as ink being discharged to a position outside the edges of the paper and the platen becoming soiled can be prevented by entering an error mode or adjusting the printing area when the position of the paper based on the determined position of the paper and the received paper width information does not match the position of the paper on the transportation path detected by a sensor.

Further preferably, the paper pulled from a roll paper in a roll paper compartment (a paper loading unit). If the roll paper is loaded in the center of the paper loading unit, loading the paper is easier and operating stability is improved when conveying the paper from the paper loading unit.

Another aspect of the invention is a printer that determines the printing reference position of the print head widthwise to the paper and prints by executing the printing control method described above.

Effect of at Least One Embodiment of the Invention

Because at least one embodiment of the invention can determine whether to execute the printing operation referenced to the center based on whether or not paper width information was received from the host device, printing can be appropriately referenced to the edge or the center of the transportation path as needed, and content can be printed correctly to the printing area of the paper whether the paper is set to a reference edge or center position. In addition, because roll paper can be loaded in the center of the paper loading unit, paper loading and operating stability are both improved. Yet further, the processing load of the printer is reduced and faster processing is enabled when printing with an edge reference because sending the paper width information from the host device is not necessary.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A printer according to a preferred embodiment of the present invention is described below with reference to the accompanying figures.

General Configuration

Figure 1:
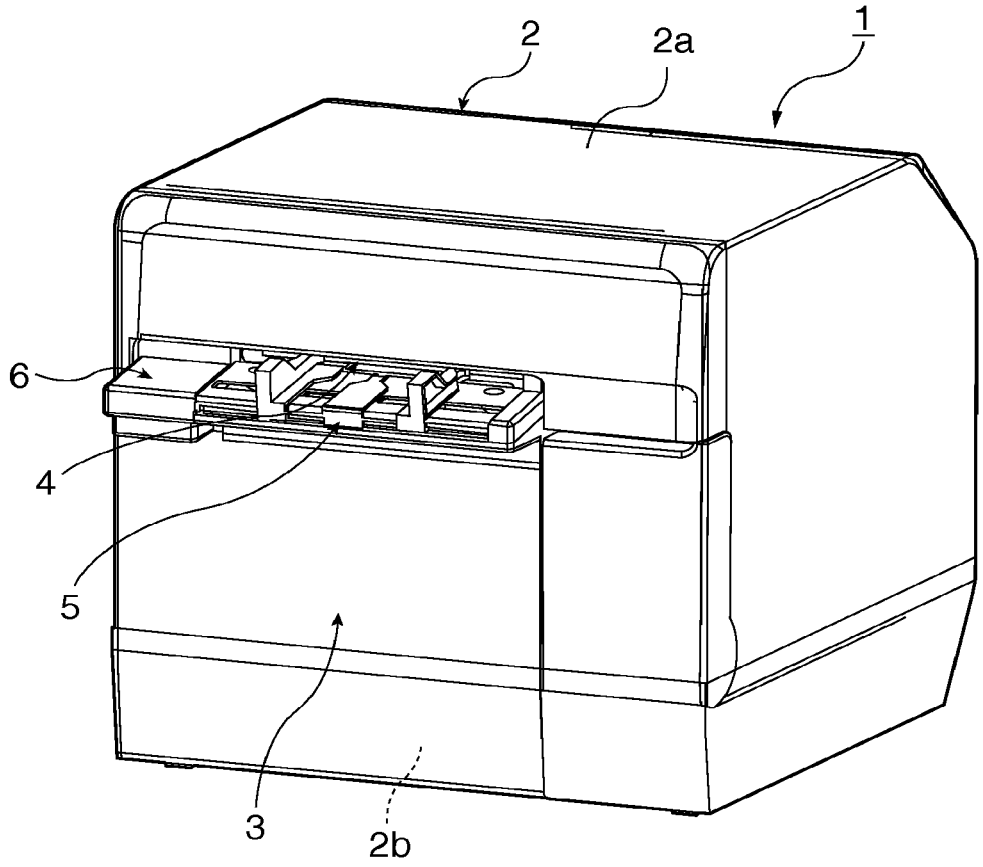
FIG. 1 is an external oblique view of a printer according to a preferred embodiment of the invention.
Figure 2:
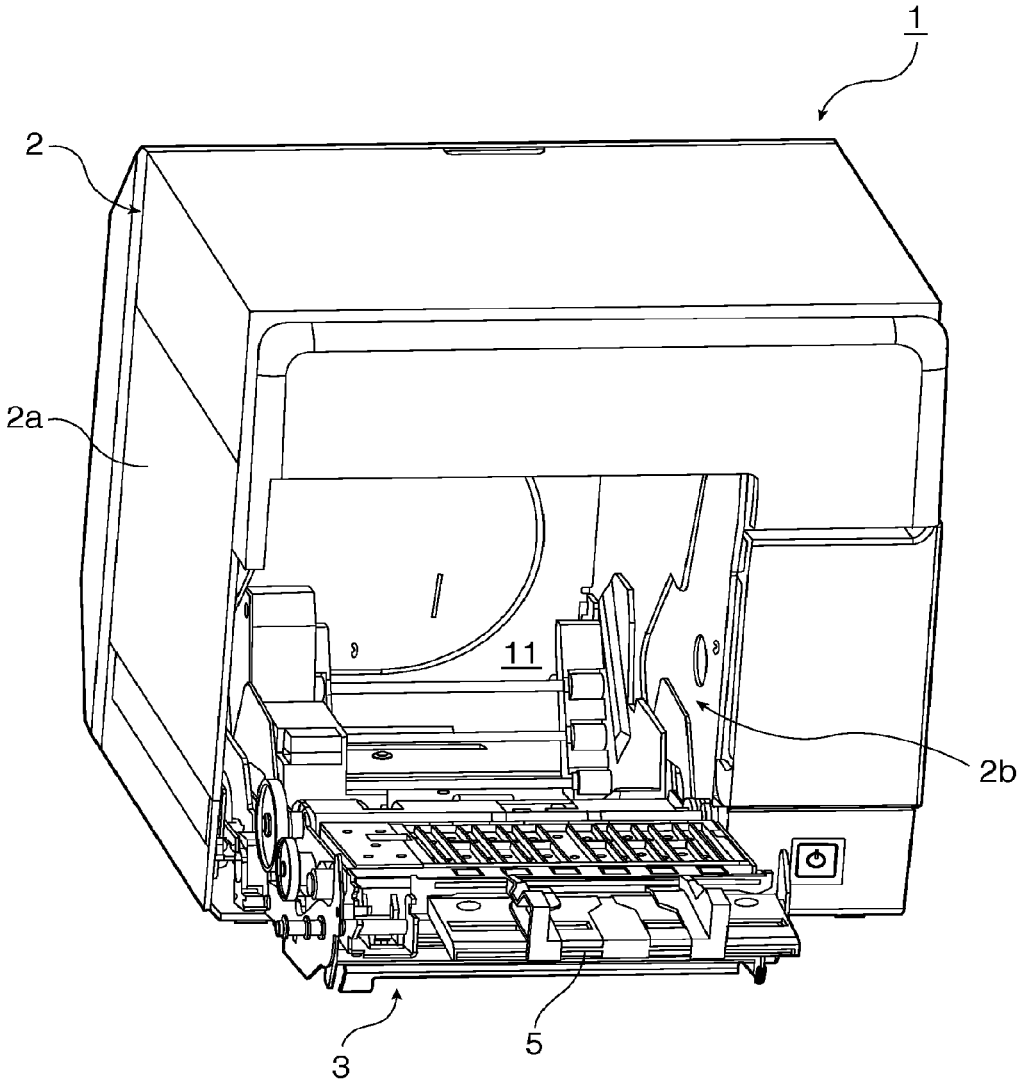
FIG. 2 is an external oblique view of the printer with the access cover open.

FIG. 1 is an oblique view showing an inkjet printer according to a first embodiment of the invention. FIG. 2 is an oblique view of the same printer with the cover completely open.

The printer 1 has a rectangular box-like body 2 and a cover 3 that opens and closes and is disposed to the front of the body 2. A paper exit 4 of a specific width is formed at the front of the outside case 2*a* part of the printer body 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3.

Operating the cover opening lever 6 unlocks the cover 3. When the exit guide 5 is pulled forward after the lock is released, the cover 3 pivots at the bottom end part thereof and opens forward to a substantially horizontal position. As shown in FIG. 2, when the cover 3 opens, the roll paper compartment 11 (paper compartment) formed inside the printer opens. The transportation path A from the roll paper compartment 11 to the paper exit 4 also opens simultaneously (see FIG. 3), and the roll paper 12 can be easily replaced from the front of the printer. Note that the cover case of the cover 3 and the cover opening lever 6 are not shown in FIG. 2.

Figure 3:
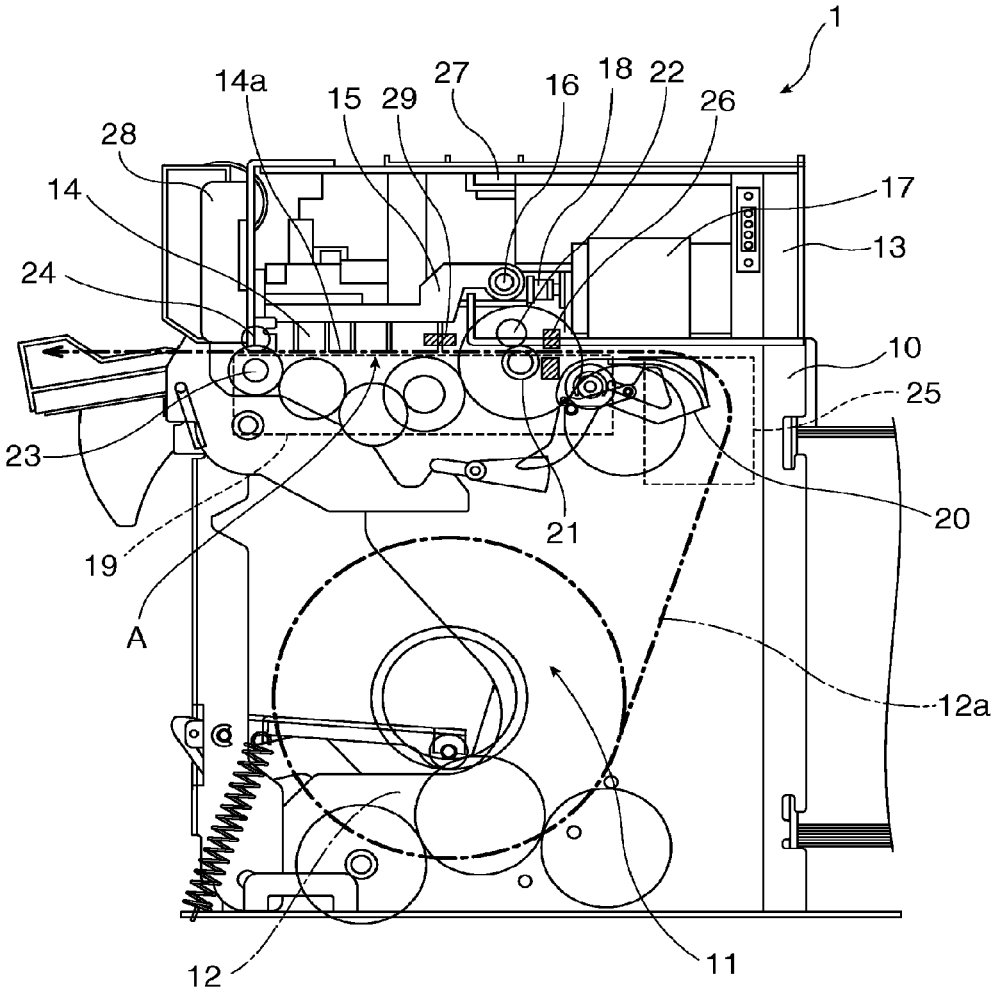
FIG. 3 is a section view showing the internal structure of the printer.

FIG. 3 shows the internal configuration of the printer 1. Roll paper 12 is stored inside the roll paper compartment 11 so that the roll paper 12 can roll on its side between the sides of the printer. The roll paper 12 is a continuous web of paper 12*a* of a constant width wound into a roll.

A head unit frame 13 is disposed horizontally at the top of the printer frame 10 above the roll paper compartment 11. Disposed to the head unit frame 13 are an inkjet head 14, a carriage 15 that carries the inkjet head 14, and a carriage guide shaft 16 that guides movement of the carriage 15 widthwise to the printer. The carriage guide shaft 16 is disposed horizontally widthwise to the printer. The inkjet head 14 is mounted on the carriage 15 with the ink nozzle surface 14*a* facing down. A carriage transportation mechanism including a carriage motor 17 and timing belt 18 for moving the carriage 15 bidirectionally along the carriage guide shaft 16 is disposed above the roll paper compartment 11.

A platen 19 extending horizontally widthwise to the printer is disposed below the inkjet head 14 with a constant gap to the ink nozzle surface 14*a*. The platen 19 determines the printing position of the inkjet head 14. A tension guide 20 that curves downward is attached on the back side of the platen 19. The tension guide 20 is urged upward by a spring force, and the paper 12*a* pulled from the roll paper 12 stored in the roll paper compartment 11 is pulled through the paper transportation path passed the printing position with a specific amount of pressure applied thereto by the tension guide 20.

A rear paper feed roller 21 and a rear paper pressure roller 22 are disposed horizontally widthwise to the printer behind the platen 19 (that is, on the upstream side in the transportation direction). The rear paper pressure roller 22 is pressed from above with a predetermined force to the rear paper feed roller 21 with the paper 12*a* therebetween. A front paper feed roller 23 and front paper pressure roller 24 are disposed on the front side of the platen 19 (downstream in the transportation direction). The front paper pressure roller 24 is pressed from above to the front paper feed roller 23 with the paper 12*a* therebetween. The rear paper feed roller 21 and the front paper feed roller 23 are rotationally driven synchronously by the paper transportation motor 25 disposed to the printer frame 10.

A paper detector 26 is disposed to a paper detection position on the upstream side of the inkjet head 14 on the transportation path A. The paper detector 26 is a reflection photosensor or a transmission photosensor, and detects whether paper 12*a* is present or the type of paper 12*a* using the transmission or reflection of light from the paper 12*a* pulled through the transportation path A.

An encoder sensor 27 mounted on the carriage 15 is disposed above the transportation path A. The encoder sensor 27 functions as a linear encoder in conjunction with a linear scale that extends through the range of bidirectional movement of the carriage 15, and functions as a position detector for detecting the positions of the carriage 15 and the inkjet head 14 widthwise to the printer. Note that instead of directly detecting the amount of carriage 15 and inkjet head 14 movement using the encoder sensor 27 and linear scale, the movement of the carriage 15 and inkjet head 14 widthwise to the printer may be calculated based on the detected rotation of the carriage motor 17 to determine the positions of the carriage 15 and inkjet head 14 widthwise to the printer.

A paper width detector 29 is disposed to the carriage 15 at a position opposite the recording surface of the paper 12*a*. The paper width detector 29 is a reflection photosensor and detects the paper width in conjunction with movement of the carriage 15 widthwise to the printer (widthwise to the paper). The paper width detector 29 detects the left edge and right edge of the paper 12*a* at the paper width detection position of the platen 19 using reflection of light from the platen 19 or the paper 12*a*.

The paper 12*a* pulled from the roll paper 12 in the roll paper compartment 11 is set with predetermined tension applied thereto by the tension guide 20 through the transportation path A (denoted by the bold dot-dash line in FIG. 3) passed the printing position of the platen 19 and out from the paper exit 4. When the paper transportation motor 25 is driven with the paper 12*a* thus loaded, the rear paper feed roller 21 and front paper feed roller 23 turn and the paper 12*a* is advanced a predetermined distance. The inkjet head 14 is also driven synchronized to conveyance of the paper 12*a* to print on the surface of the paper 12*a* as it passes the printing position. Paper transportation is then stopped with the printed portion of the paper 12*a* hanging out from the paper exit 4, the leading portion of the paper 12*a* is cut by the paper cutter 28 disposed near the paper exit 4, and the printed portion of the paper is discharged.

Control System

Figure 4:
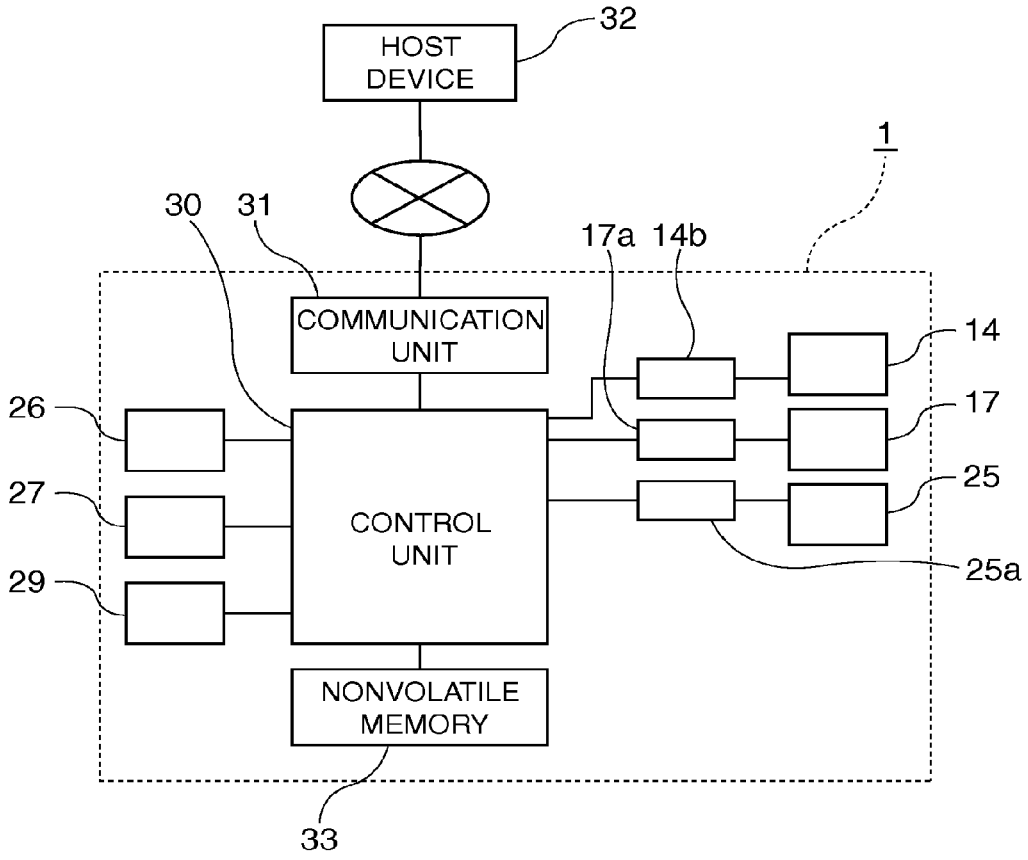
FIG. 4 is a schematic block diagram showing the control system of the printer.

FIG. 4 is a schematic block diagram showing the control system of the printer 1. The control system of the printer 1 is constructed around a control unit 30 including a CPU, ROM, and RAM. Nonvolatile memory 33 such as flash ROM is also connected to the control unit 30. Print data and commands are supplied from an external device such as a host device 32 through a communication unit 31 to the control unit 30. Based on print commands and other data from the host device 32, the control unit 30 controls driving the paper feed mechanism and the carriage transportation mechanism to convey the paper 12*a* to advance the print medium and print.

The inkjet head 14 is connected to the output side of the control unit 30 through the print head driver 14*b*, and the control unit 30 controls driving the inkjet head 14 through the print head driver 14*b*. The carriage motor 17 and paper transportation motor 25 are connected to the output side of the control unit 30 through a motor driver 17*a* and motor driver 25*a*, and the control unit 30 controls driving the paper transportation motor 25 and carriage motor 17 through the motor drivers 25*a* and 17*a*. The control unit 30 can calculate the distance the paper 12*a* is conveyed by integrating the number of steps or the rotational distance that the paper transportation motor 25 is driven in the advancing direction.

The paper detector 26 is connected to the input side of the control unit 30. The control unit 30 detects if the paper 12*a* is present on the transportation path A at the detection position where the paper detector 26 is disposed to the transportation path A based on the detected output of the paper detector 26. The control unit 30 may alternatively execute a paper type detection operation to determine at the paper detection position the type of paper that is loaded in the roll paper compartment 11. For example, the paper 12*a* that is pulled from the roll paper 12 and loaded in the transportation path A may be conveyed a predetermined distance and the type of paper that is used as the paper 12*a* may be determined based on the detected output of the paper detector 26. By controlling the parts of the printer 1 based on the detected type of paper, the control unit 30 can also optimize the printing operation for the paper.

The encoder sensor 27 and the paper width detector 29 are also connected to the input side of the control unit 30. The control unit 30 executes the detection operation using the paper width detector 29 by controlling driving the carriage transportation mechanism to move the inkjet head 14 and the carriage 15 widthwise to the paper 12*a* set in the transportation path A. The control unit 30 compares the detection output of the paper width detector 29 with a predetermined threshold value to detect when the paper width detector 29 passes over the edge of the paper 12*a*. The width of the paper 12*a* is detected by detecting how far the carriage 15 moves between the left edge and right edge of the paper 12*a* based on the output of the encoder sensor 27. Alternatively, the left edge position and right edge position of the paper 12*a* may be detected by detecting how far the carriage 15 moves when the carriage 15 moves from the home position to the left edge and the right edge of the paper 12*a*.

Determining the Start Printing Position

Figure 5A:
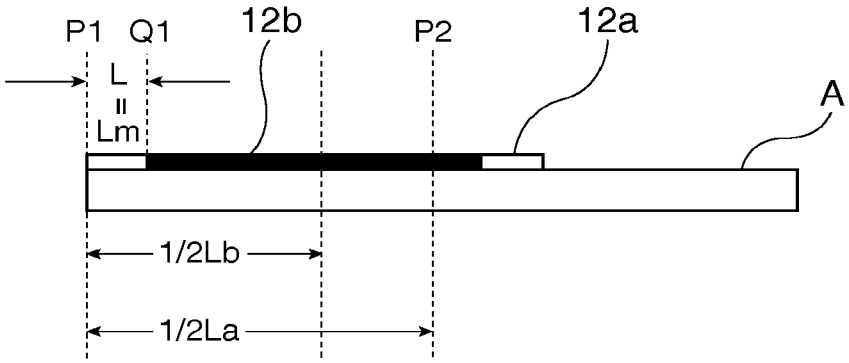
FIG. 5A describes the position of the paper when the paper is set to an edge reference position.

The process of determining the start printing position of the inkjet head 14 is described next. FIG. 5A describes when the paper is set to an edge reference position, and FIG. 5B describes when the paper is set to the center reference position. The control unit 30 starts printing with the ink discharge nozzles of the inkjet head 14 positioned to the left edge of the printing area 12*b* defined for the paper 12*a* set to the transportation path A. In other words, the position of the left edge of the printing area 12*b* is the start printing position (printing reference position) of the inkjet head 14.

When the paper 12*a* is set to the left-edge reference, the paper 12*a* is set so that the left edge of the paper 12*a* aligned with the left edge P1 of the transportation path A. In this situation the start printing position Q1, which is the position of the left edge of the printing area 12*b*, is the position moved to the right by the margin Lm on the left side of the printing area 12*b* of the paper 12*a*.

However, when the paper 12*a* is set to the center reference, the paper 12*a* is loaded with the center of the paper 12*a* aligned with the center P2 of the transportation path A. In this situation the start printing position Q2, which is the position of the left edge of the printing area 12*b*, will be shifted distance L from the left edge P1 of the transportation path A where $$\text{distance } L=\tfrac{1}{2}La-\tfrac{1}{2}Lb+Lm$$

La is the width of the transportation path A, Lb is the width of the paper 12*a*, Lm is the width of the margin on the left side of the paper 12*a*, and La is substantially the same as the maximum paper width.

When the printer 1 receives print data from the host device 32, it interprets the received print data. Based on the interpreted content, the printer 1 executes the process of determining the start printing position for printing the print data.

Figure 5B:
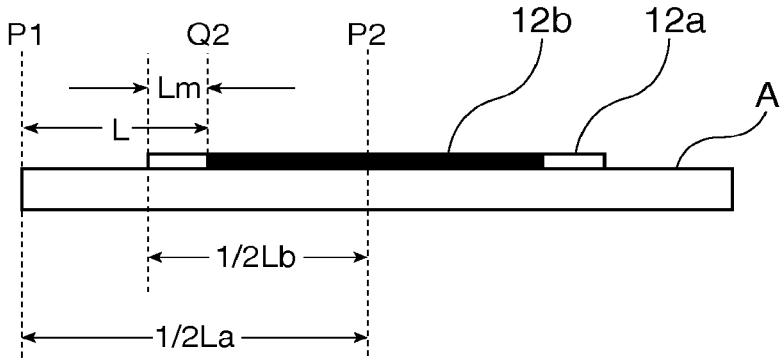
FIG. 5B describes the position of the paper when the paper is set to a center reference position.
Figure 6:
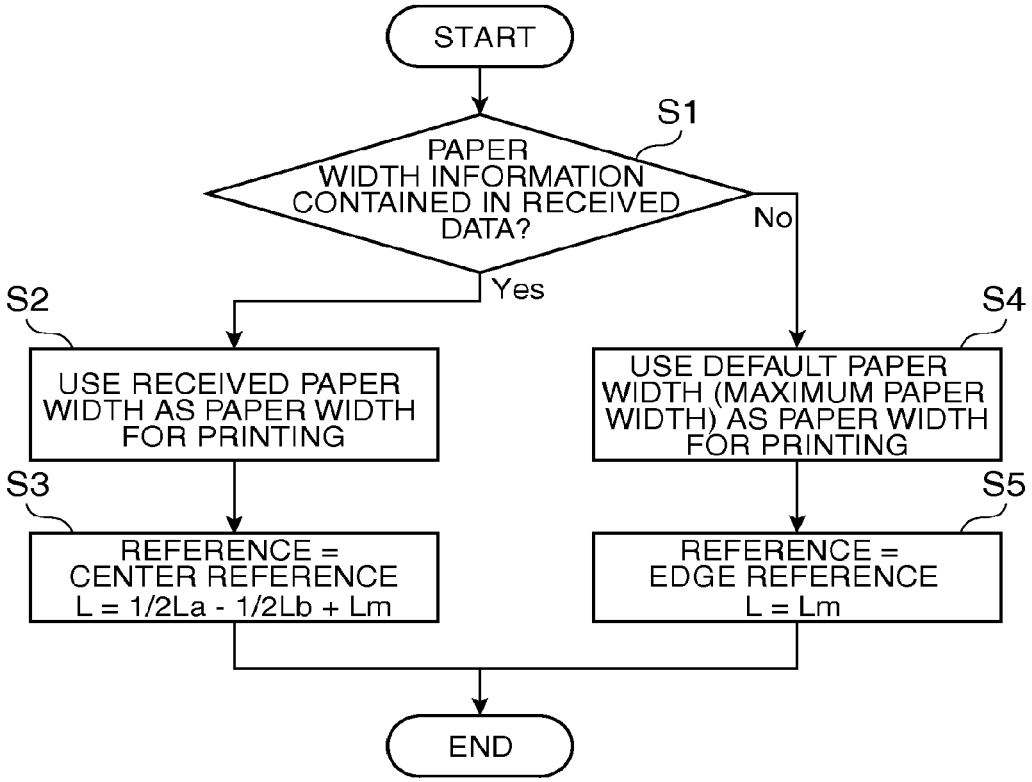
FIG. 6 is a flow chart of the start printing position determination process.

FIG. 6 is a flow chart of the start printing position determination process. In step S1 the control unit 30 determines if the paper width information is contained in the received data. If the paper width information is contained (step S1 returns Yes), control goes to step S2 and the received paper width is set as the paper width of the paper 12*a* to be used for printing. Control then goes to step S3 and the start printing position is determined assuming that the paper 12*a* is set to the center reference. As a result, in step S3 the distance L from the left edge P1 of the transportation path A to the start printing position is set to $$L=\tfrac{1}{2}La-\tfrac{1}{2}Lb+Lm$$

based on the location of start printing position Q2 shown in FIG. 5B.

However, if the paper width information is not contained in the received data (step S1 returns No), control goes to step S4, the default paper width previously stored in nonvolatile memory 33 is read, and this default paper width is used as the width of the paper 12*a*.

In this embodiment of the invention the default paper width is set to the maximum paper width that can be set in the transportation path A, that is, width La is substantially equal to the width of the transportation path A. The paper width value that was previously received and stored in nonvolatile memory 33 may be read and used at this time. Control then goes to step S5 and the start printing position is determined based on the paper 12*a* being set to the left-edge reference. As a result, in step S5 the distance L from the left edge P1 of the transportation path A to the start printing position is set to L=Lm based on the location of the start printing position Q1 shown in FIG. 5A.

The width Lm of the margin on the left side of the paper 12*a* may be previously stored in the nonvolatile memory 33 of the printer 1, or it may be received from the host device 32. Alternatively, similarly to when the paper width is not received, a default margin may be used if the size of the margin is not contained in the received data, and the received margin may be used if the margin is contained in the received data. Further alternatively, if the margin was previously received and stored in nonvolatile memory 33, the margin may be read from memory and used.

Figure 7:
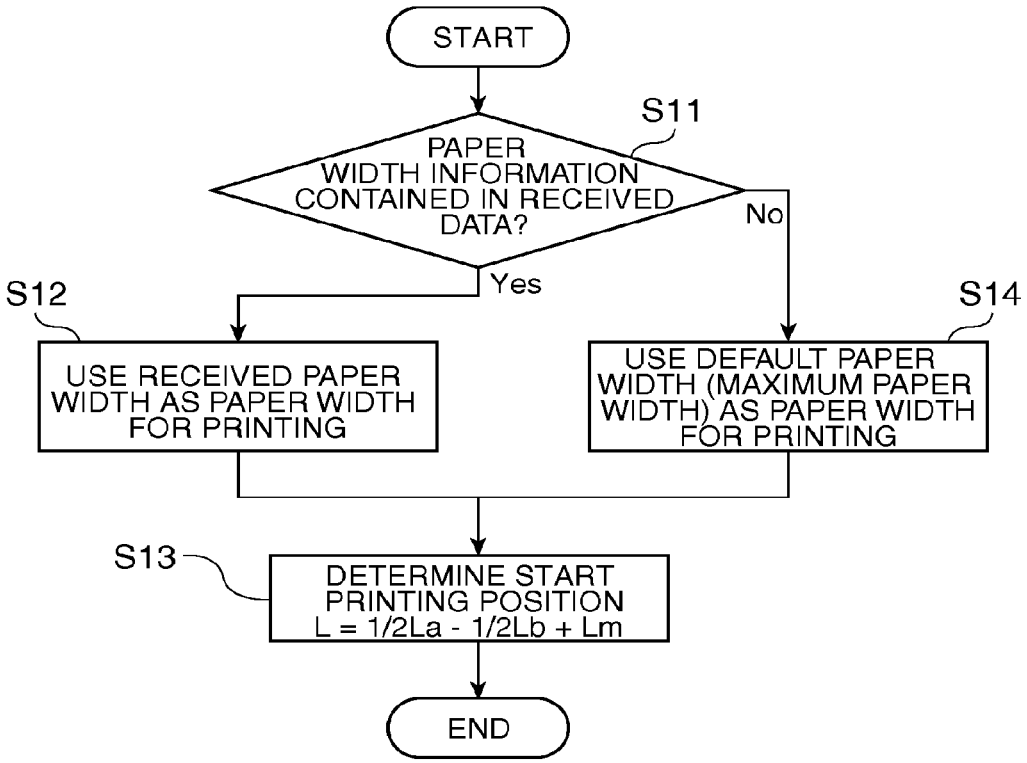
FIG. 7 is a flow chart of another start printing position determination process.

If the width Lb of the paper 12*a* is substantially equal to the width La of the transportation path A, that is, the maximum paper width, then distance L=½La−½Lb+Lm=Lm, the start printing position will be the same position as when the paper is set to the left-edge reference, and the start printing position can be determined based on the left-edge reference or on the center reference. Therefore, if the default paper width that is used when the paper width information is not contained in the received data is the maximum paper width, the process can be modified to use only the method of determining the start printing position based on the center reference. FIG. 7 is a flow chart of the process determining the start printing position using only the center reference. Steps S11 to S14 in the decision process shown in FIG. 7 are identical to steps S1 to S4 in the decision process shown in FIG. 6. The process in FIG. 7 omits step S5, goes from step S4 to step S3, and determines the start printing position using the center-referenced determination method when using the default paper width.

When the start printing position determination process ends, the printer 1 executes the paper feed operation and printing operation to print the received data. At this time the process of detecting the width of the paper 12*a* by the paper width detector 29 is executed at the paper width detection position of the platen 19 before the operation of aligning the printing area of the paper 12*a* with the printing position of the platen 19 is completed. As a result, the width of the paper 12*a* being conveyed, and the positions of the left and right widthwise edges of the paper 12*a*, are known.

When the paper width information is received, the control unit 30 detects the width by the paper width detector 29. Whether the set position of the paper determined from the received paper width information matches the detected position of the paper is determined. If these positions are determined to not match, a paper error results and an error handling process such as displaying a specific error message and stopping operation is executed. Alternatively, the result of detection by the paper width detector 29 may be prioritized and the printing area of the inkjet head 14 adjusted so that printing does not exceed the edges of the paper. For example, a masking process (that is, not printing) may be applied to the part of the print data that exceeds the width of the paper 12*a* set in the transportation path A, and the inkjet head 14 may be controlled to print only within the detected width of the paper.

Effect of at Least One Embodiment of the Invention

As described above, a printer 1 according to this embodiment of the invention can determine whether to control printing referenced to the paper center by determining whether or not paper width information is contained in the received data, uses the center reference only if the paper width information is contained in the received data, and can adjust the start printing position of the inkjet head 14 according to the paper width.

If the paper width information is not contained in the received data, the start printing position can be set so that printing is executed using a left-edge reference to paper 12*a* of a preset default paper width. A left-edge reference and a center reference can therefore be used appropriately as needed, and the printer 1 can print correctly to the printing area 12*b* of the paper 12*a* even if the paper 12*a* is sent to the center-referenced position. The roll paper 12 can therefore be loaded in the center of the roll paper compartment 11, and the ease of loading the roll paper 12 and operating stability can be improved. Furthermore, because it is not necessary to include the paper width information in the received data sent from the host device 32 when printing using a left-edge reference, the processing load of the printer 1 is reduced and faster processing is possible.

This embodiment of the invention also determines the width of the paper 12*a* used for printing based on the received paper width information, and determines the start printing position referenced to the center for the paper 12*a* of the determined paper width. As a result, the roll paper 12 can be loaded in the center of the roll paper compartment 11 to improve the ease of loading the roll paper 12 and operating stability while the start printing position of the inkjet head 14 can be determined and content can be printed correctly within the printing area 12*b* of the paper 12*a*.

Because this embodiment of the invention can determine the margins and paper width based on information that is previously stored or received from the host device 32 side, soiling of the platen 19 or shifting of the printing position caused by detection errors by the paper width detector 29 do not occur. Furthermore, because either an error state is entered or the printing width is adjusted so that content is only printed within the detected width of the paper when the detection result from the paper width detector 29 does not match the set position of the paper determined from the paper width information, problems such as soiling the platen 19 by discharging ink to positions outside of the paper can also be prevented.

Other Embodiments

The paper width information may also be sent to the printer 1 at a different time than when the print data is sent.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing control method comprising:

receiving data from a host device;

when paper width information which indicates a width of the paper is received from the host device, printing the data on a paper from a first position based on at least a width of a transportation path of the paper in a paper width direction and the width of the paper; and when the paper width information is not received from the host device, printing the data on the paper from a second position based on a margin on one side end of the paper in the paper width direction.

2. The printing control method described in claim 1, wherein the first position is a distance ½La−½Lb+Lm from one side end of the transportation path in the paper width direction, the second position is a distance Lm from one side end of the transportation path in the paper width direction, where La is a width of the transportation path in the paper width direction, Lb is the width of the paper, and Lm is the margin on one side end of the paper.

3. The printing control method described in claim 2, wherein the one side end of the paper is a left side end of the paper in the paper width direction.

4. The printing control method described in claim 1, wherein the first position is referenced to a center of the transportation path in the paper width direction, and the second position is referenced to an edge of the transportation path in the paper width direction.

5. The printing control method described in claim 1, wherein when the paper width information is not received from the host device, the data is printed on the paper with a maximum paper width being set as a pre-stored paper width of the paper, and a distance L from a left edge of the transportation path to a start printing position is set to L=Lm where Lm is the margin on one side end of the paper.

6. The printing control method described in claim 1, wherein the one side end of the paper is a left side end of the paper in the paper width direction.

7. The printing control method described in claim 1, wherein printing the data comprises moving a print head mounted on a carriage.

8. The printer described in claim 1, wherein the paper is pulled from a roll paper in a roll paper compartment.

9. A printer connectable to the host device and configured to execute the printing control method described in claim 1.

* * * * *